United States Patent [19]

Harrington

[11] 3,976,141

[45] Aug. 24, 1976

[54] SPRINKLER HEAD SHUT-OFF MECHANISM

[75] Inventor: Charles L. Harrington, Southfield, Mich.

[73] Assignee: Wigma Corporation, Royal Oak, Mich.

[22] Filed: June 24, 1975

[21] Appl. No.: 589,938

[52] U.S. Cl. ..... 169/90; 138/89

[51] Int. Cl.[2] ..... A62C 37/20

[58] Field of Search ..... 169/90, 37; 138/89

[56] References Cited

UNITED STATES PATENTS

| | | | |
|---|---|---|---|
| 2,234,290 | 3/1941 | Tessier | 138/89 X |
| 2,466,126 | 4/1949 | Siegel | 169/90 |
| 2,538,485 | 1/1951 | Tessier | 138/89 X |
| 3,550,687 | 12/1970 | Thaxton | 169/90 |

FOREIGN PATENTS OR APPLICATIONS

| | | | |
|---|---|---|---|
| 99,657 | 3/1962 | Norway | 169/90 |

*Primary Examiner*—John J. Love
*Assistant Examiner*—Michael Mar
*Attorney, Agent, or Firm*—Harness, Dickey & Pierce

[57] ABSTRACT

After the sprinkler heads alone or with other means has put out a fire, applicant's device is extremely useful for shutting off the flow of water from the heads to minimize the damage resulting from the continuous flow of water. The device is effective to shut off the water from the sprinkler heads whether or not the heads are mounted so that the opening is located at the top or bottom or with heads having openings at the top and also openings at the bottom. The device is so constructed as to seal off either type of opening when applied to a sprinkler head.

7 Claims, 3 Drawing Figures

SPRINKLER HEAD SHUT-OFF MECHANISM

BACKGROUND OF THE INVENTION

The following patents were developed in a search in the Patent Office and provides a good disclosure of the types of similar devices known in the art: U.S. Pat. Nos.

| | |
|---|---|
| 868,058 | 2,985,242 |
| 891,038 | 3,191,685 |
| 2,324,170 | 3,223,171 |
| 2,417,265 | 3,550,687 |
| 2,538,485 | 3,837,406 |
| 2,555,461 | 3,848,676 |
| | 56,791 — Danish |

SUMMARY OF THE INVENTION

The invention pertains to a scissors-like device made up of two channel shaped elements each having a flat web and two upstanding sides which taper to the outer ends from a central pin which connects the two sides together. A coiled spring centered by the pin has two arms extending on one side thereof against the webs which are moved apart while the webs on the other side of the pin are moved toward each other. A tinnerman type of nut is formed in one of the webs which are moved toward each other in which a thread on an end of a shaft is screwed. The shaft end beyond the thread has a ball end pressed against the inner face of the opposite web so as to have the webs at the opposite ends of the elements disposed at a converging angle. The converging webs have on their outer surfaces an elastomeric material, adhered or otherwise secured thereto, so spaced as to be in parallel relation when engaging and providing a seal to the sprinkler head outlet opening. The elastomeric material on the other web is in engagement with the inner opposite edge of a projecting ring which supported the actuating arms which were expelled when the low melting point solder was released by the heat to permit water to squirt from the opening. With this arrangement, the head may be delivering water upwardly or downwardly and will be closed off when the end of the device having the elastomeric material on both webs is inserted in the ring and the staff is unscrewed along the nut to permit the spring to urge the webs and the elastomeric material apart for sealing the delivery opening whether it is at the top or bottom of the sprinkler head.

DESCRIPTION OF THE PREFERRED EMBODIMENT

Figure 1:
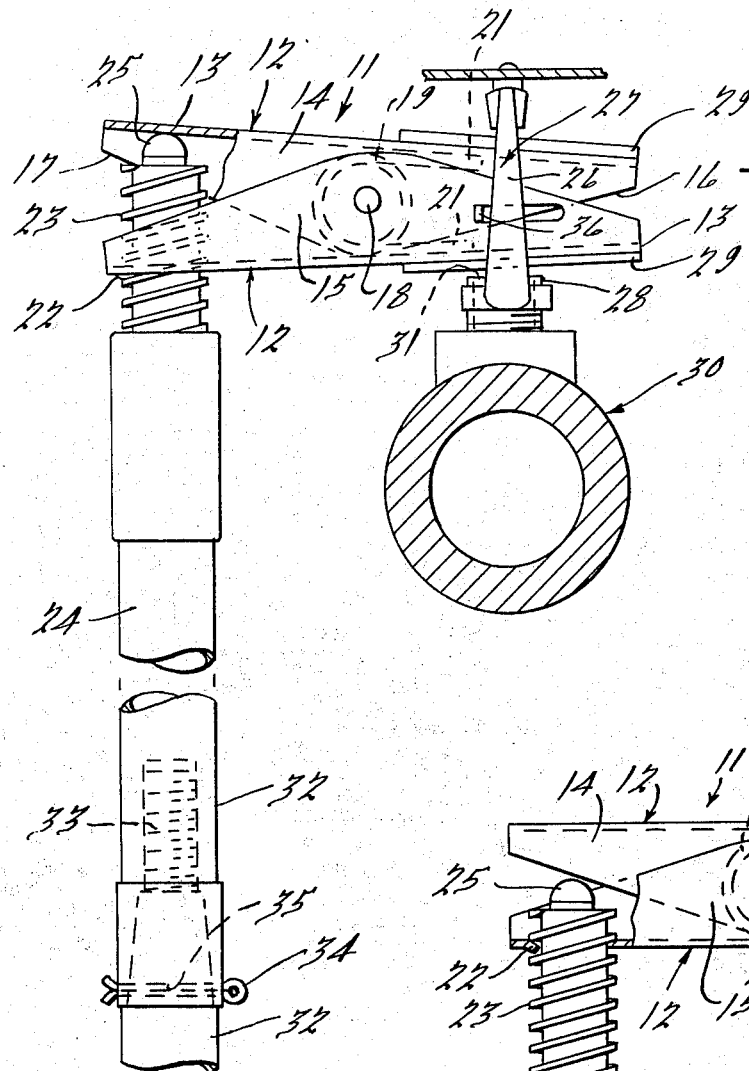
FIG. 1 is a broken view of a device of the present invention for sealing a sprinkler head which deflects the water upwardly with the ends of the device deflected and inserted within the head.

The invention pertains to a scissors-like device 11 made of two like channel shaped elements 12 each having a web 13 and two side flanges 14 and 15. The side flanges 14 and 15 taper toward the ends 16 and 17 and the flanges 14 are disposed within the flanges 15 and secured together approximately at the center by a pin 18. A coil spring 19 of substantial wire size is disposed about the pin 18 with the ends 21 extending toward the end 16 and resting against the inner face of the webs 13. The end 17 of the bottom web 13 has a tinnerman type of nut 22 formed therein for engagement with a thread 23 on the end of a shaft 24 which has a ball head 25 on the end which engages the inner face of the opposite web 13. When screwed into the nut 22 the end 16 has its webs 13 disposed closer together than when in horizontal position so that the end of the device can be inserted within a ring 26 on the sprinkler head 27 on the wall of the outlet 28 from which the water is issuing. This can be done while the operator is standing on the floor and since the end 16 of the device is captured within the ring 26, the shaft 24 may be screwed outwardly from the nut 22 and completely removed therefrom. This permits the ends 21 of the springs 19 to substantially force the webs apart to move them in substantially horizontal relation to each.

Figure 2:
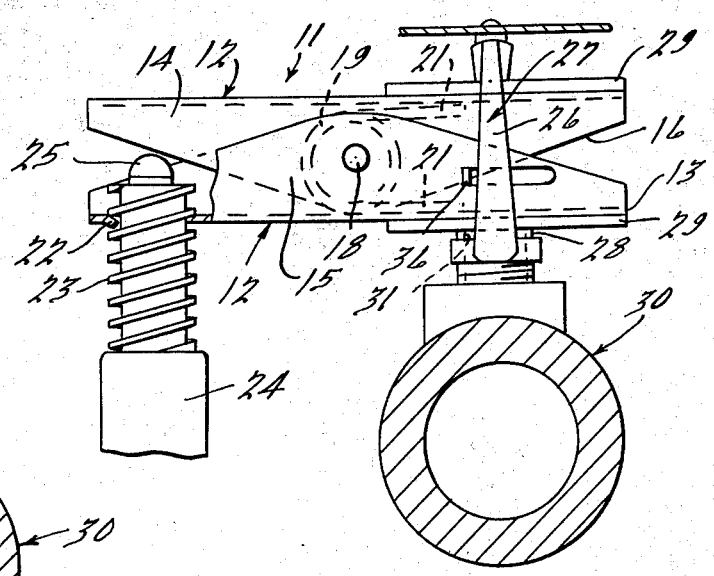
FIG. 2 is a view of the structure illustrated in FIG. 1 with the elements of the device moved by a spring into sealing relation.

The outer surface of the ends of the webs 13 located at the end 16 of the device, has strips of elastomeric material 29 adhered or otherwise secured thereto which are moved into substantially horizontal relation to each other when the strip 29 on the bottom web 13 is moved into engagement with the opening 31 in the wall of the outlet 28 from which the water is flowing so as to stop the flow of water and permit the operators to apply a new device 11 onto the end of the shaft 24. In FIG. 1, the device is illustrated with the webs 13 at the end 16 in adjacent relation when inserted into the ring 27. In FIG. 2, the device is illustrated when the shaft 24 is being removed and the spring has sealed off the opening 31.

Figure 3:
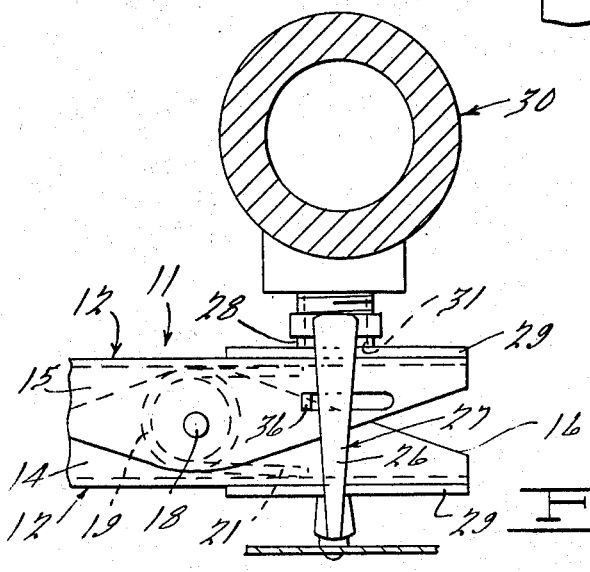
FIG. 3 is a view of structure, similar to that illustrated in FIG. 2 showing the device applied to a sprinkler head which directs the water downwardly.

In FIG. 3, the device 11 is applied to the shaft 24 in the same manner to have the webs 13 at the ends 16 moved into adjacent relation, as illustrated in FIG. 1, so that the ends may be inserted into the ring 26 which is now pointing downwardly from the opening 31. The sprinkler head 27 has the same construction as the head of FIGS. 1 and 2 except that it is inverted on the supply pipe 30 to have the water flow from the opening 31 in a downwardly direction. By removing the shaft 24, the ends 21 of the spring will urge the elastomeric material 29 on the webs 13 away from each other into horizontal position in a similar manner as it was moved in FIG. 2 so that the opening 31 can be sealed off by one of the strips of elastomeric material 29.

The shaft 24 may be made of a plurality of sections 32 which are secured together by mated male and female threaded ends 33 and are prevented from being separated, when the thread 23 is screwed from the nut 22, by a cotter pin 34 extending in aligned apertures 35 through the ends of the sections to provide a small package for shipment. The fact that the two elements which make up the scissors-like device 12 are of similar construction and have the elastomeric material on the webs at the same end so as to function to shut off the water at either the top or bottom of the head is believed of unique construction and provides a positive shut-off device which is inexpensive. Fingers 36 are lanced from the sides 15 of the element 12 to strike the ring 26 when the device 11 is inserted therein to locate the elastomeric strips 29 relative to the outlet opening 31.

We claim:

1. In a shut-off unit for an open sprinkler head to stop the flow of water therefrom after its closure element has been opened, a pair of like channel shaped elements having a flat web and right angle sides with the sides of one element telescoped within the sides of the other element, a pin joining the sides together at substantially the center, a coiled spring through which the pin extends having arms in engagement with the inner surface of the webs at the forward insertable end of the unit, a nut associated with one of the webs at the rearward end of said unit, a shaft having a thread insertable in said nut and in engagement with the opposite web for forcing the spring-urged end of the webs toward each other so as to be able to enter a ring about the opening of the sprinkler head, and a strip of elastomeric material on the outer surface at the ends of the webs which are spring pressed away from each other, one of said strips engages the inner surface of the ring, the other of which engages the wall of the opening through which the water was flowing to provide a seal therefor.

2. In a shut-off unit as recited in claim 1, wherein the end of the shaft beyond the thread has a rounded surface to provide a point engagement with the inner surface of the web opposite to that having the nut.

3. In a shut-off unit as recited in claim 1, wherein the nut is cut within the web and flanged to provide an effective thread turn for the nut.

4. In a shut-off unit as recited in claim 3, wherein the elastomeric material on the forward ends of the webs will seal the wall of the opening from which the water is flowing whether directed upwardly or downwardly.

5. In a shut-off unit as recited in claim 3, wherein the unit is effective for closing off the wall of the opening in the sprinkler head when the water from some of the heads is directed upwardly and from other of the heads is directed downwardly, the same shut-off unit being useable on either of the heads when inserted in the ring of the heads in the same position.

6. In a shut-off unit as recited in claim 1, wherein the shaft is made from a plurality of short sections having male and female threads on mating ends so that when joined together a shaft is provided of substantial length, said male and female thread sections having apertures therethrough, and pins disposed through said apertures when in aligned relation for preventing the unthreading of the sections when the thread in the end of the shaft is being screwed from the nut on the shut-off element.

7. In a shut-off unit as recited in claim 1, wherein struck-out fingers from the outer sides of one of the elements are provided for limiting the insertion of the ends of the element to within the ring.

* * * * *